US010415264B1

(12) United States Patent
Turner

(10) Patent No.: US 10,415,264 B1
(45) **Date of Patent: *Sep. 17, 2019**

(54) REMOVABLE SPA AND SWIM SPA COVER LIFTER WITH UNDERMOUNT

(71) Applicant: Donna Turner, Bradenton, FL (US)

(72) Inventor: Donna Turner, Bradenton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/591,091

(22) Filed: May 9, 2017

Related U.S. Application Data

(63) Continuation of application No. 14/834,432, filed on Aug. 24, 2015, now Pat. No. 9,644,382.

(51) Int. Cl.
*E04H 4/08* (2006.01)

(52) U.S. Cl.
CPC ..... *E04H 4/084* (2013.01)

(58) Field of Classification Search
CPC ..... E04H 4/084; A61H 33/6005
USPC ..... 4/498, 557
See application file for complete search history.

(56) References Cited

U.S. PATENT DOCUMENTS 5,974,600 A * 11/1999 Pucci ..... E04H 4/084 4/498
6,381,766 B1 5/2002 Perry
9,644,382 B1 * 5/2017 Turner ..... E04H 4/084
2009/0049595 A1 * 2/2009 Muller ..... E04H 4/084 4/500
2010/0313352 A1 * 12/2010 Sloss ..... E04H 4/084 4/498
2013/0031713 A1 * 2/2013 Kite ..... E04H 4/084 4/498
2015/0345163 A1 * 12/2015 Cunerty ..... E04H 4/084 4/498

* cited by examiner

*Primary Examiner* — Tuan N Nguyen
(74) *Attorney, Agent, or Firm* — Burr & Forman LLP; Jeffrey H. Kamenetsky

(57) ABSTRACT

A spa and swim spa cover lifter having a footplate with an elongated undermount that becomes secured under a spa or swim spa for added lifter stability and strength during the raising and lowering of a spa cover. The upper structure of the cover lifter is quickly and easily separated from the footplate, allowing its prompt removal for spa maintenance without the burden/expense of emptying and refilling the spa. The upper structure comprises two vertically-extending supports each having at least one permanently attached L-shaped bracket providing lateral sway reduction for the supports under load. At least one fastener removably secures each vertically-extending support and its associated brackets to the wider/exposed end of the footplate. The bottom part of each fastener is preferably fixed to the footplate. A pre-assembled body comprising adjustable spa cover support arms and lifting-assist/lowering-assist member is fixed to the vertically-extending supports using two height adjustment knobs.

20 Claims, 9 Drawing Sheets

REMOVABLE SPA AND SWIM SPA COVER LIFTER WITH UNDERMOUNT

CROSS-REFERENCES TO RELATED APPLICATIONS

This U.S. utility patent application herein claims domestic priority benefit of a prior U.S. utility patent application Ser. No. 14/834,432, filed by the same inventor herein on Aug. 24, 2015, and entitled "Removable Swim Spa Cover Lifter with Undermount". Since the U.S. utility patent application herein is being filed on the same date, May 9, 2017, that the patent grant for the invention disclosed in U.S. utility patent application Ser. No. 14/834,432, issued as U.S. Pat. No. 9,644,382, domestic priority benefit based upon U.S. utility patent application Ser. No. 14/834,432 for the application herein being filed before midnight on the Issue Date should be proper and allowed.

BACKGROUND OF THE INVENTION—FIELD OF THE INVENTION

This invention relates to devices assisting the removal and replacement of covers used with spas and swim spas, specifically to a cover lifter usable with swim spas holding approximately 20,000 gallons of water and having a large cover, that is also adjustable for alternative use with smaller spas only holding about 800 gallons of water and having a much smaller cover. The present invention cover lifter is also adjustable for use with covers for spas and swim spas having different thickness dimensions. In addition, it has upper portions that can be promptly removed from and reattached to its footplate in only a few minutes, allowing spa maintenance without having to empty and refill the associated spa or swim spa, and overcoming a significant disadvantage of the prior art.

The present invention spa and swim spa cover lifter is also structurally sounder and stronger than known spa and swim spa cover lifters for long-term repeat use with the larger and heavier covers of swim spas, which are gaining in popularity. In addition, the present invention's triangular braces on the larger ones of its L-shaped brackets assist in lateral support for raised elevation of its J-shaped arms up to approximately 48-inches, whereas the known prior art only extends upwardly to a height of approximately 21-inches. The present invention spa and swim spa cover lifter comprises a footplate with an elongated undermount portion that is completely positioned under the spa or swim spa when the present invention is in its position of use, two vertically-extending supports each having at least one L-shaped bracket for lateral support permanently secured to its lower end, and a total of at least two easily separated two-part fasteners, at least one of which are used to releasably connect each of the vertically-extending supports and its attached L-shaped bracket or brackets to the exposed portion of the footplate depending from the elongated undermount hidden under the spa or swim spa during present invention use. A pre-assembled body having a rotation axis and hydraulic lift is releasably attached to the upper ends of the two vertically-extending supports, and is used to raise and lower two connected adjustable and movable J-shaped spa and swim spa cover support arms secured to the upper end of its hydraulic lift. The vertically-extending supports are configured to provide alternative height positioning for the cover support arms, a lower elevation for use with a spa cover, and a higher elevation for use with a swim spa cover. Furthermore, to achieve quick and easy release of the vertically-extending supports from the footplate and their prompt reinstallation thereto at a later time, one part of each fastener, preferably the bolt portion (although the nut or bolt cap used could be substituted), is welded and/or otherwise permanently secured to the footplate. The lifting-assist/lowering-assist hydraulic member is shown in the accompanying illustrations only between the J-shaped cover support arms and on one side of the present invention pre-assembled body, however, this structural limitation is not considered critical.

BACKGROUND OF THE INVENTION—DESCRIPTION OF THE RELATED ART

Spa cover lifters and support apparatus are known to assist the removal of a cover prior to spa use, and replacement of the cover when spa use is complete. A disadvantage of known spa cover lifters is that many have structures necessitating attachment to the exterior surface of a spa or swim spa, and also attachment to the spa's cover, which at least in part blocks convenient access to the spa's water circulation equipment when maintenance, inspection, or repair is needed. To remove these cover lifters requires emptying of water from the spa and later refilling it, adding to the time and expense involved. Since the upper portions of the present invention are easily and promptly separated and removed from the present invention footplate, its use allows immediate access to the spa's water circulation equipment without having to empty water from the spa, overcoming a significant disadvantage of the prior art. One U.S. Pat. No. 6,381,766 to Perry (May 7, 2002) is known to disclose a pair of base plates 48, which in its FIGS. 4 and 5 are each shown to be positioned in part under a different lateral portion of a spa, in opposed positions to one another. However, as can be also seen in the same FIGS. 4 and 5, the undermount portion of the Perry invention is much smaller in surface area than that in the applicant's invention, it does not have the same configuration as the present invention footplate, and the Petty base plates 48 are not centrally located under the spa. As a result, the Perry invention would have insufficient strength and stability to lift the larger swim spa covers to a raised height of approximately 48-inches. In addition, the Perry invention is different from the present invention as it has connections to opposed lateral exterior surfaces of a spa, as well as to opposed lateral exterior surfaces of the spa cover, both of which the present invention lacks. No invention is known to have all of the features and advantages of the present invention.

SUMMARY OF THE INVENTION

The primary objective of this invention is to provide an adjustable cover lifter that can be alternatively used for spas and swim spas of differing height, as well as with spa and swim spa covers having differing thickness dimensions. It is a further objective of this invention to provide a spa and swim spa cover lifter having upper portions that can be easily and promptly removed from its footplate, and later easily and promptly reattached thereto, without having to empty water from the associated spa or swim spa for maintenance, inspection, and/or repair purposes. It is also an objective of this invention to provide a spa and swim spa cover lifter that is strengthened for extended stable use with heavy swim spa covers up to a raised elevation of approximately 48-inches. In addition, it is an objective of this invention to provide a spa and swim spa cover lifter that is made from strong and durable materials that are resistant to premature deterioration from exposure to spa chemicals, cleaning agents, and outdoor weathering elements. It is also an objective of this invention to provide a spa and swim spa cover lifter with fasteners that easily release the vertically-extending supports from the footplate without the need for a tool. A further objective of this invention is to provide a spa and swim spa cover lifter that is cost efficient in design and construction, and able to achieve a compact collapsed configuration for low-profile and unobtrusive storage against the side of a spa or swim spa.

The present invention is a spa and swim spa cover lifter with upper portions that can be promptly removed from and reattached to its footplate for spa maintenance purposes without having to empty and refill the associated spa or swim spa, overcoming a significant disadvantage of the prior art. It is also strengthened over known spa and swim spa cover lifters for long-term repeat use with the larger and heavier covers of swim spas for extended periods of time at elevations up to approximately 48-inches. The present invention spa and swim spa cover lifter comprises a footplate with an elongated undermount portion that is completely positioned centrally under one side of the spa or swim spa when the present invention is in its position of use, two vertically-extending supports each with at least one lateral-sway-reducing L-shaped bracket secured to its lower end, and a total of at least two easily separated two-part fasteners, at least one of which are used to releasably connect each of the vertically-extending supports, as well as its attached L-shaped bracket or brackets, to the exposed portion of the footplate depending outwardly beyond the side wall of the associated spa or swim spa, while its elongated undermount remains hidden under the spa or swim spa during present invention use. A pre-assembled body, which includes connected adjustable J-shaped spa cover support arms and a lifting-assist/lowering-assist hydraulic member, is secured to the upper ends of the vertically-extending supports with two height adjustment knobs, with the vertically-extending supports allowing alternative positioning of the support arm at a lower elevation for use with a spa cover, or at a higher elevation for use with a swim spa cover. To achieve quick and easy release of the vertically-extending supports from the footplate while the elongated undermount of the footplate remains under the spa or swim spa, one portion of the fastener (preferably the bolt) is welded and/or otherwise permanently secured to the footplate, providing rotational leverage while the upper portion of the fastener is released and later reattached.

COMPONENT LIST

Figure 1:
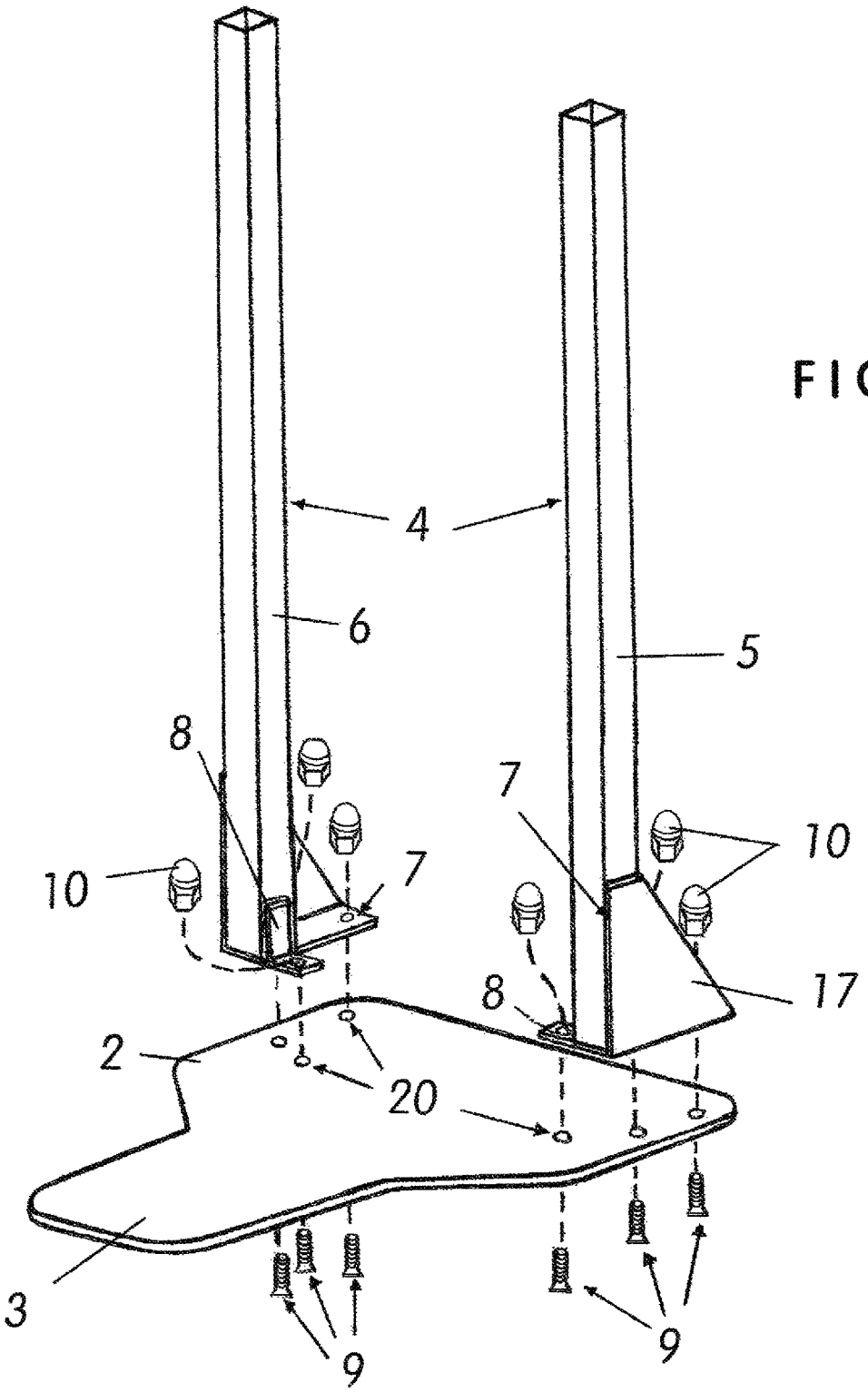
FIG. 1 is an exploded view of the footplate with elongated undermount, vertically-extending supports, fasteners, and two L-shaped brackets that can be used as a part of a first preferred embodiment of the present invention, with broken lines indicating preferred locations of fastener connection.

1—Removable Swim Spa Cover Lifter with Undermount
2—Footplate (preferably eight-sided)
3—Elongated Undermount portion/end of footplate 2
4—Two Vertically-Extending Supports (they have lateral positioning on footplate 2, are releasably secured to footplate 2, and provide adjustability for the J-shaped cover arms 11 to receive spa and swim spa covers 19 at differing position heights)
5—Outside Surface of vertically-extending support 4 (remotely located from the opposed vertically-extending support 4)
6—Inside Surface of vertically-extending support 4 (located in a position facing the other laterally positioned vertically-extending support 4)
7—Larger L-Shaped Bracket having a vertically-extending surface providing a substantially triangular brace 17 (L-shaped bracket 7 is removably connected to footplate 2, but permanently fixed to the outside surface 5 of a vertically-extending support 4)

8—Smaller L-shaped Bracket (Bracket 7 is optional, and when used is connected between footplate 2 and the inside surface 6 of a vertically-extending support 4, with permanent connection to the vertically-extending support 4 and releasable connection to footplate 2 via fasteners 9/10)

9—Fastener (three are used with each vertically-extending support 4 to removably attach it to footplate 2, fasteners 9 and bolt caps 10 together provide three points of attachment for lateral support of vertically-extending supports 4 under load and one part thereof is preferably welded to footplate 2)

10—Bolt Caps (rounded head nuts are preferred for easy hand-manipulation without tools)

11—Two J-shaped Spa Cover Support Arms

12—Lifting-Assist/Lowering-Assist Hydraulic Member connected to pre-assembled body 22 and used for rotation of J-shaped cover support arms 11 about rotation axis 24 between a raised position to receive a spa or swim spa cover and multiple lowered positions

13—Height Adjustment Knobs used between pre-assembled body 22 and each vertically-extending support 4, aligning the height of cover support arms 11 to the height of the spa or swim spa cover 19 (typically threaded, and configured for manual tightening)

Figure 7:
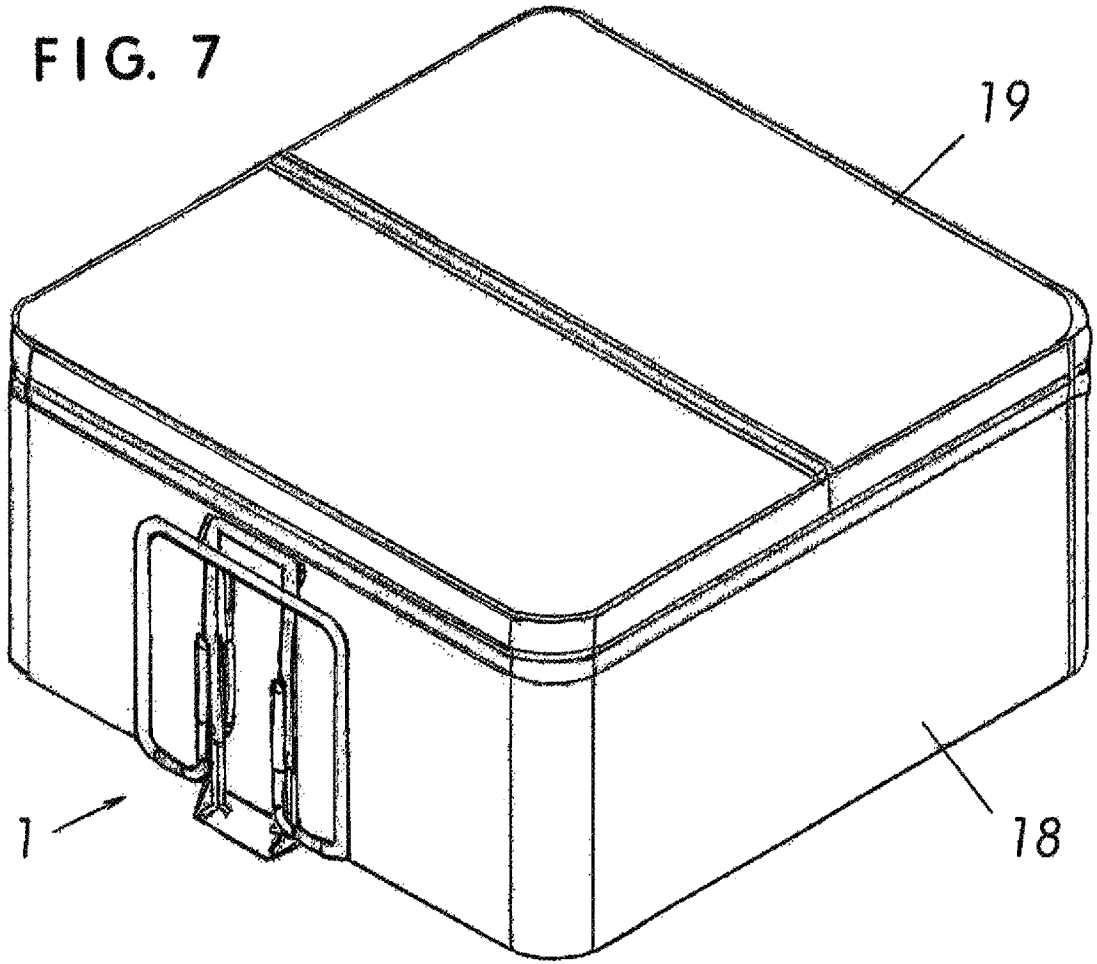
FIG. 7 is perspective view from the top of a spa with the most preferred embodiment of the present invention shown in FIG. 4 secured against one side of the spa, the spa cover deployed completed over the top of the spa and the present invention shown in a collapsed, compact, and low-profile storage configuration.

14—Two Expandable Joints on each J-shaped cover support arm 11 (each joint is expandable in two places, the joints closer to the distal ends of the cover support arms 11 allowing for width adjustment of the cover support arms 11 to accommodate different spa cover 19 thickness, and the joints closer to the pre-assembled body 22 allowing for length adjustment of the larger covers 19 of swim spas, the lengthening joint also allowing rotation of cover support arms 11 for collapsed/compact storage in a low-profile and unobtrusive position adjacent to a spa or swim spa 18, see FIG. 7)

15—Multiple Holes in vertically-extending support 4 used for height adjustment of the connected J-shaped cover support arms 11 from a lower position usable with a smaller spa cover to a higher position needed for use with a swim spa cover 18

16—Welded Connection and/or other strong/secure connection between the vertically-extending supports 4 and portions of the two L-shaped brackets 7 and 8 (although not revealed in the views of the accompanying illustrations, welded connection 16 is also used between substantially triangular brace 17 and the adjacent vertically-extending support 4, between the lower end of each vertically-extending support 4 and the horizontally-extending portion of a larger L-shaped bracket 7 and to secure fasteners 9 to footplate 2)

17—Substantially Triangular Brace comprising the vertically-extending surface of the larger L-shaped bracket 7

18—Spa or Swim Spa

19—Cover for a spa or swim spa

20—Multiple Holes through footplate 2 and into which fasteners 9 are securely fixed

21—Two Fastener Holes through L-shaped bracket 7 and One Fastener Hole through L-shaped bracket 8 each used for the insertion of a different fastener 9

22—Pre-Assembled Body (includes the connected J-shaped cover support arms 11 and the hydraulic lifting-assist/lowering-assist member 12)

Figure 5:
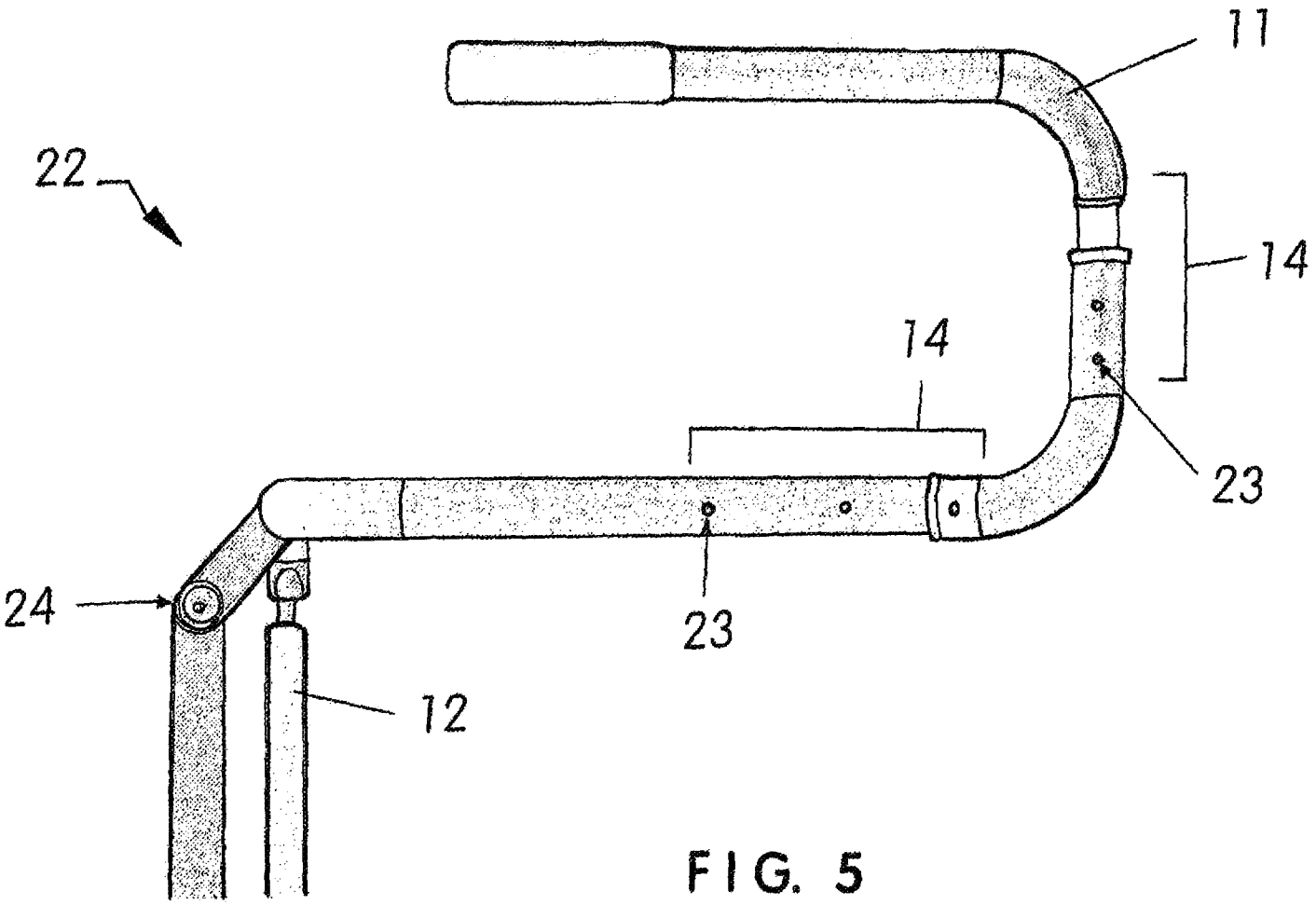
FIG. 5 is an enlarged view from the side showing one of the cover support arms in FIG. 4 and the preferred configuration and positioning of its expandable joints.

23—Adjustment Push Pins (in expandable joints 14, see FIG. 5)

24—Rotation Axis on pre-assembled body 22 (allows rotational movement of connected cover support arms 11 between raised and lower positions)

DETAILED DESCRIPTION OF THE INVENTION

The present invention is a spa and swim spa cover lifter 1 having the elongated undermount portion/end 3 of its footplate 2 positioned under an adjacent spa or swim spa 18, two vertically-extending supports 4 upwardly-depending from the wider and non-elongated portion/end of footplate 2, and a pre-assembled body 22 (that includes two connected J-shaped cover support arms 11 and a lifting-assist/lowering-assist hydraulic member 12) connected to the top ends of the vertically-extending supports 4 using two height adjustment knobs 13. The vertically-extending supports 4 and the cover support arms 11 provide adjustment means for present invention 1, allowing the present invention spa and swim spa cover lifter 1 to be used with both spas and swim spas 18, as well as a variety of spa and swim spa covers 19 having differing length and thickness dimensions. Since swim spa covers 19 are typically heavy, lifting-assist/lowering-assist hydraulic member 22 extends between the connected cover support arms 11 and the remainder of pre-assembled body 22 for controlled rotation of cover support arms 11 about a rotation axis 24 for removal and replacement of the spa or swim spa cover 19. Furthermore, since one part of each two-part fastener (9, 10) fixing the vertically-extending supports 4 to the present invention footplate 2 is permanently attached to the footplate 2, the vertically-extending supports 4 can be promptly released from, and reconnected to, the footplate 2 for spa or swim spa 18 maintenance without having to remove water from the spa or swim spa 18, saving time and expense. When the word 'spa' is used hereinafter, it is intended that its use includes both spa and swim spas, unless otherwise indicated in the context.

FIGS. 1-6 show varying views of a first and most preferred embodiment of the present invention. FIG. 1 is an exploded view of the footplate 2 with its elongated undermount 3, two vertically-extending supports 4, six fasteners 9, six rounded head nuts 10, and four L-shaped brackets 7 and 8 used as a part of the most preferred embodiment of the present invention 1, with broken lines indicating preferred locations of fastener 9 and nut 10 connections. Each of the L-shaped brackets has a substantially vertically-extending portion depending upwardly from a substantially horizontally-extending portion, and as shown in FIG. 1, two of the four L-shaped brackets are larger and provide more connecting surface area than the two smaller L-shaped brackets. In addition, FIG. 1 shows the vertically-extending portions of the larger L-shaped brackets 7 each providing a substantially triangular brace that is larger in surface area than its substantially rectangular horizontally-extending portion, while each of the smaller L-shaped brackets 8 has vertically-extending and horizontally-extending portions that are similar to one another in their size and substantially rectangular shape. FIG. 1 shows footplate 2 having an eight-sided perimeter (preferably with rounded corners, but not limited thereto), with fasteners connecting vertically-extending supports 4 in laterally opposed positions on its wider end that is situated remotely from its elongated undermount portion 3. The outside surface 5 on the vertically-extending supports 4 is designated as being in a remote position from the opposed vertically-extending support 4. In contrast, the inside surface 6 of the opposing vertically-extending support 4 is designated as being in a position facing the other support 4. The substantially triangular-shaped braces 17 in the larger L-shaped brackets 7 used as a part of the most preferred embodiment of the present invention 1 each have a fixed connection (preferably via welding) to the outside surface 5 of a different one of the vertically-extending supports 4, with the lower end of the same vertically-extending support 4 also fixed (preferably via welding) to the horizontally-extending portion of the larger L-shaped bracket 7 depending from the vertically-extending brace 17. However, the connection of the two larger L-shaped brackets 7 to footplate 2 is easily releasable, and preferable via two-part fasteners (9, 10), with one portion of each two-part fasteners 9, 10 (preferably fastener 9, but possibly nut 10) welded (or otherwise fixed permanently) to footplate 2. FIG. 1 further shows each of the two smaller L-shaped brackets 8 connected between footplate 2 and the inside surface 6 of a different one of the vertically-extending supports 4. The sizes, configurations, and relative positioning of the footplate 2, smaller L-shaped brackets 8, larger L-shaped brackets 7, and vertically-extending supports 4 may vary somewhat from that shown, and that shown in FIG. 1 should not be strictly considered as limiting as long as each effectively fulfills its intended function.

Figure 2:
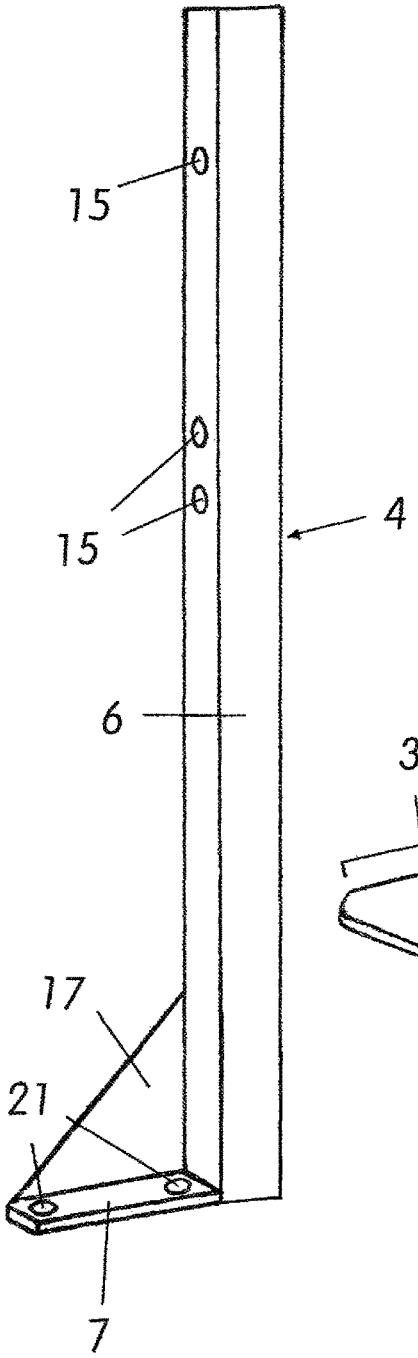
FIG. 2 is an enlarged perspective view of the reverse side of a vertically-extending support similar to that shown in FIG. 1, but without the smaller L-shaped bracket, demonstrating that its presence in optional.
Figure 3:
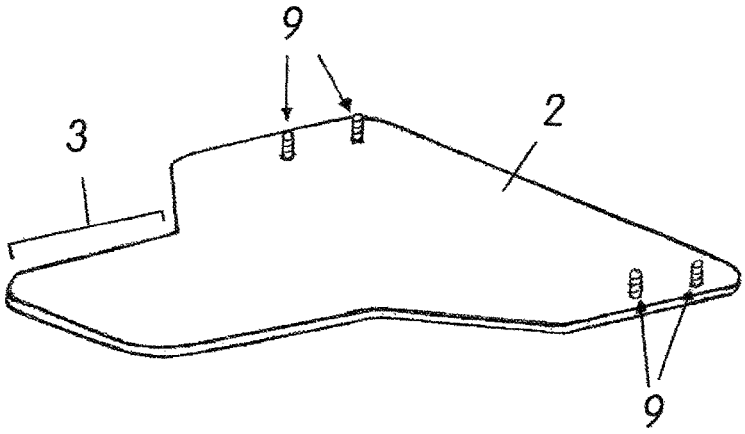
FIG. 3 is an enlarged view of a footplate similar to that shown in FIG. 1 to which one part of four two-part fasteners are used, for attaching two vertically-extending supports without smaller/optional L-shaped bracket, similar to that shown in FIG. 2.

FIG. 2 is an enlarged perspective view of one of the two vertically-extending supports 4 shown in FIG. 1, while FIG. 3 is an enlarged view of a footplate similar to that shown in FIG. 1 to which one part (fastener 9) of four two-part fasteners 9, 10 are used as a separate attachment point for vertically-extending supports 4 to footplate 2, for reduced lateral sway when vertically-extending supports 4 become positioned at a raised elevation of approximately 48" under load. FIG. 2 shows the holes 15 in each vertically-extending support 4 that allow height adjustment of the pre-assembled body 22 and J-shaped cover support arms 11 for use alternatively with smaller spas and larger swim spas. FIG. 2 also better shows the substantially triangular-shaped brace 17 associated with the larger L-shaped bracket 7, but does not include the smaller L-shaped bracket 8, demonstrating that it is considered as an optional invention component. The larger L-shaped bracket 7 is shown to have two holes 21 for releasable attachment to footplate 2 via two fasteners 9 and two rounded head nuts 10. Although not shown in FIG. 2, it is also contemplated for the substantially triangular-shaped brace 17 associated with the larger L-shaped bracket 7 to have welded connection 16 to the outside surface 5 of vertically-extending support 4. In addition, FIG. 3 more clearly defines the configuration of the elongated undermount 3 of footplate 2 through use of a bracket connected to the line extending from the numeral 3.

Figure 4:
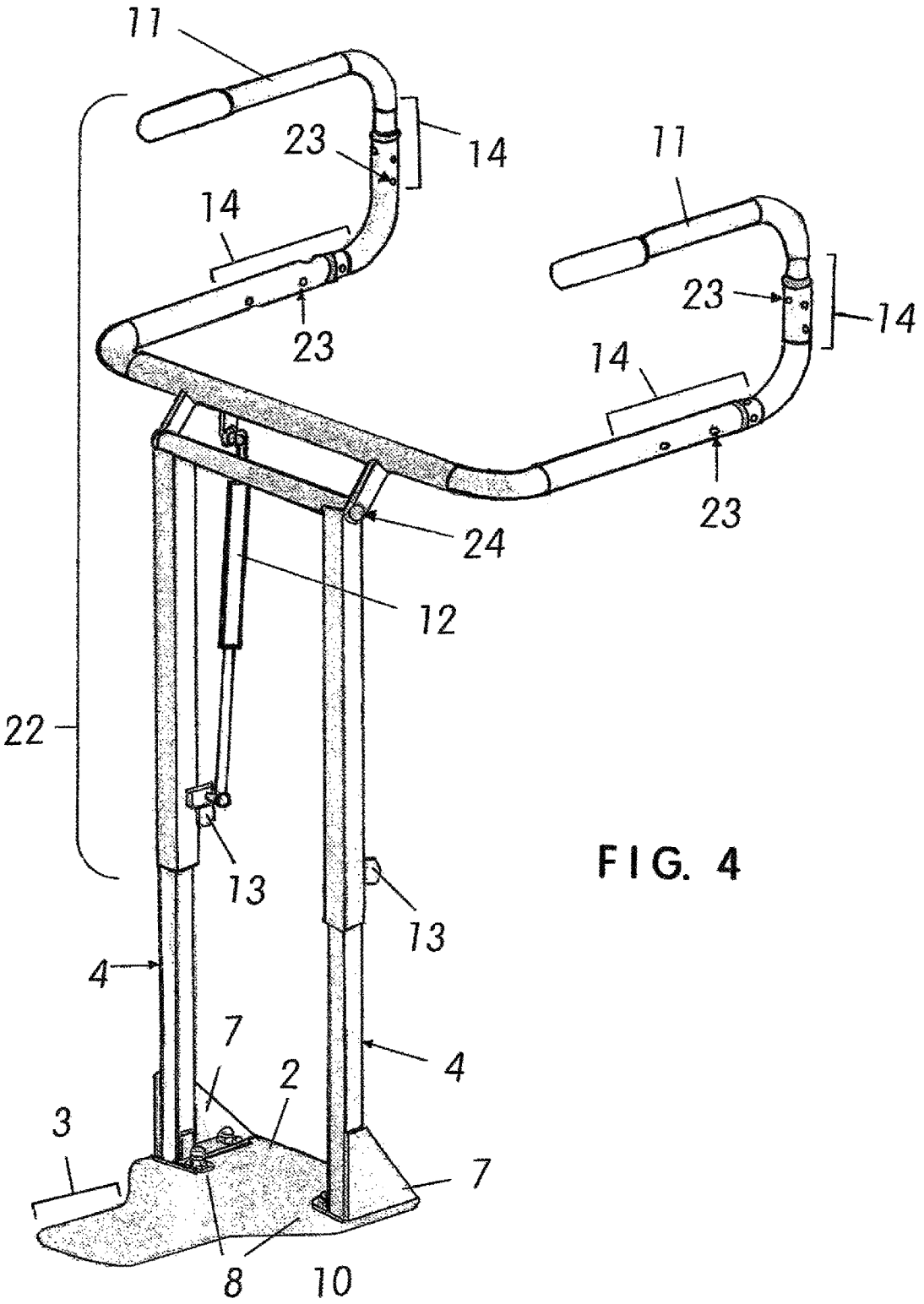
FIG. 4 is a perspective view of the assembly in FIG. 1 from the rear that is further shown with pre-assembled body secured to the upper ends of the vertically-extending supports via two height adjustment knobs, the pre-assembled body including two connected and adjustable J-shaped cover support arms, the cover support arms each having two expandable joints to accommodate spa and swim spa covers of differing thickness and length dimension, and the cover support arms also shown rotated into the raised and substantially horizontally-extending orientation needed to receive a spa or swim spa cover.
Figure 6:
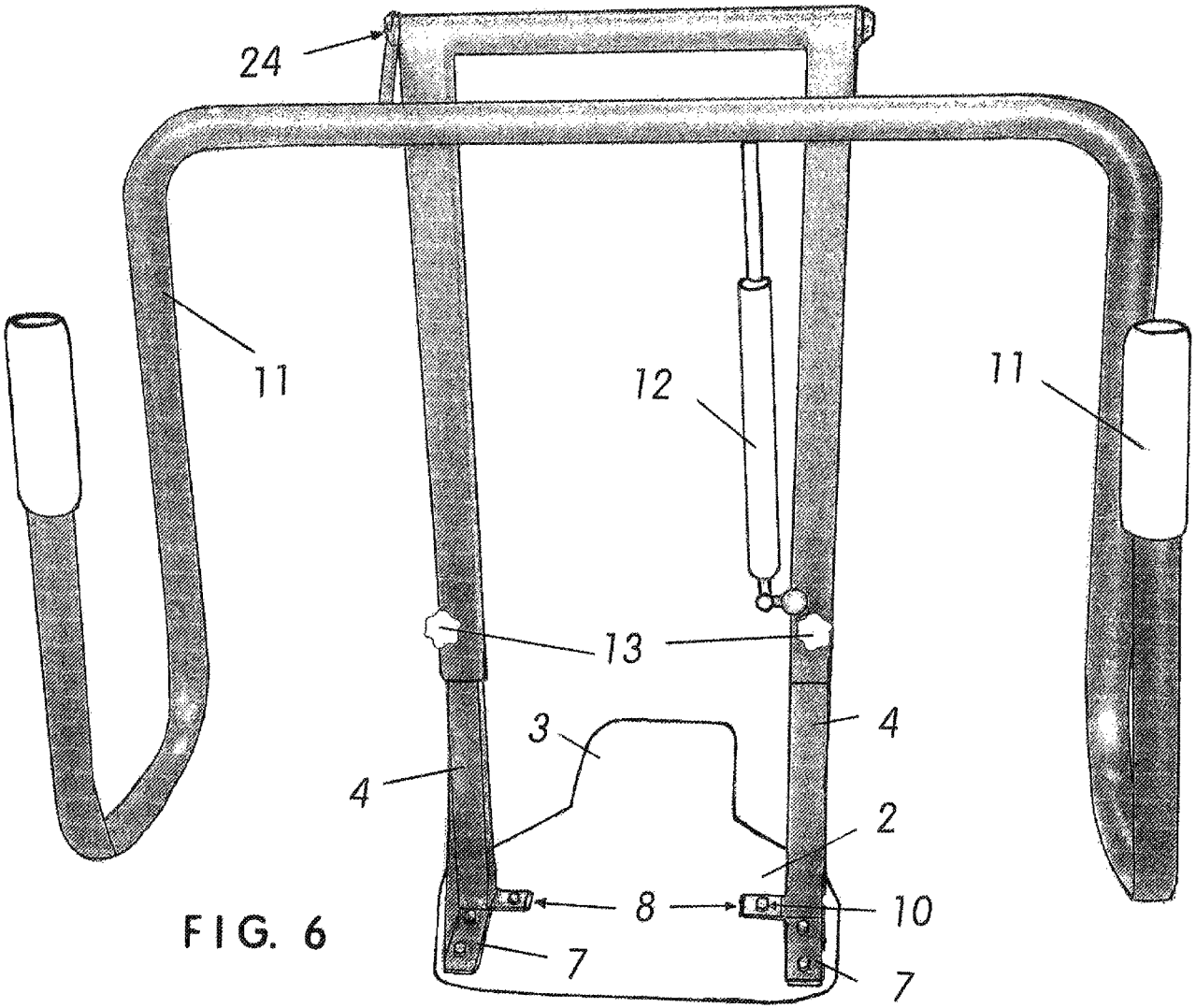
FIG. 6 is a front view of the most preferred embodiment of the present invention shown in FIG. 4, with its cover support arms in a substantially vertically-extending orientation used to support a spa or swim spa cover in an out-of-the-way/remote position during spa or swim spa use, the cover support arms not showing the expandable and rotating joints preferred to accommodate spa and swim spa covers of differing thickness and length.

FIGS. 4-6 show the pre-assembled body 22 and connected J-shaped arms 11 as they are used as a part of the most preferred embodiment of the present invention 1. FIG. 4 is a perspective view of the present invention from the rear (side facing a spa or swim spa 18) and shows the pre-assembled body 22 secured to the upper ends of the vertically-extending supports 4 via height adjustment knobs 13 that lock the releasable but temporarily fixed positioning of pre-assembled body 22 to the vertically-extending supports 4 at a selected height. FIG. 4 also shows a lifting-assist/lowering-assist hydraulic member 12 connected to pre-assembled body 22 to help raise and lower J-shaped cover support arms 11 about a rotation axis 24 under load. As shown in FIGS. 4 and 5, the cover support arms 11 include expandable joints 14 allowing accommodation of spa and swim spa covers 19 of differing thickness and length. In addition the expandable joints 14 providing length accommodation also allow cover support arms 11 to rotate toward and away from one another. This allows the cover support arms 11 to remain open while in the raised and horizontally-extending orientation needed to receive a spa or swim spa cover 19, yet also achieve a low-profile configuration for compact storage when not in use. FIG. 6 also shows the lifting-assist/lowering-assist hydraulic member 12 connected between the connected J-shaped cover support arms 11 and the lower portion of the pre-assembled body 22. FIG. 6 further shows the most preferred embodiment of footplate 2 having an eight-sided perimeter, with rounded head nuts 10 securing the two vertically-extending supports 4 via the four L-shaped brackets 7 and 8 shown to hidden fasteners 9 fixed to footplate 2 in positions remote from the elongated undermount portion 3. The connection of L-shaped brackets 7 and 8 to footplate 2 is fixed, but releasable. FIG. 5 is an enlarged view from the side of the expandable joints 14 in one of the cover support arms 11 shown in FIG. 4, which also shows the adjustment push pins 23 used for lengthening and widening cover support arms 11 to accommodate spa and swim spa covers 19 of differing length and thickness dimension. FIG. 6 is a front view of the most preferred embodiment of the present invention shown in FIG. 4, with its cover support arms 11 in a vertically-extending orientation used to support a spa or swim spa cover 19 in an out-of-the-way/remote position during spa or swim spa use, the cover support arms 11 not showing the expandable joints 14 preferred to accommodate spa and swim spa covers 19 of differing thickness and length.

Figure 8:
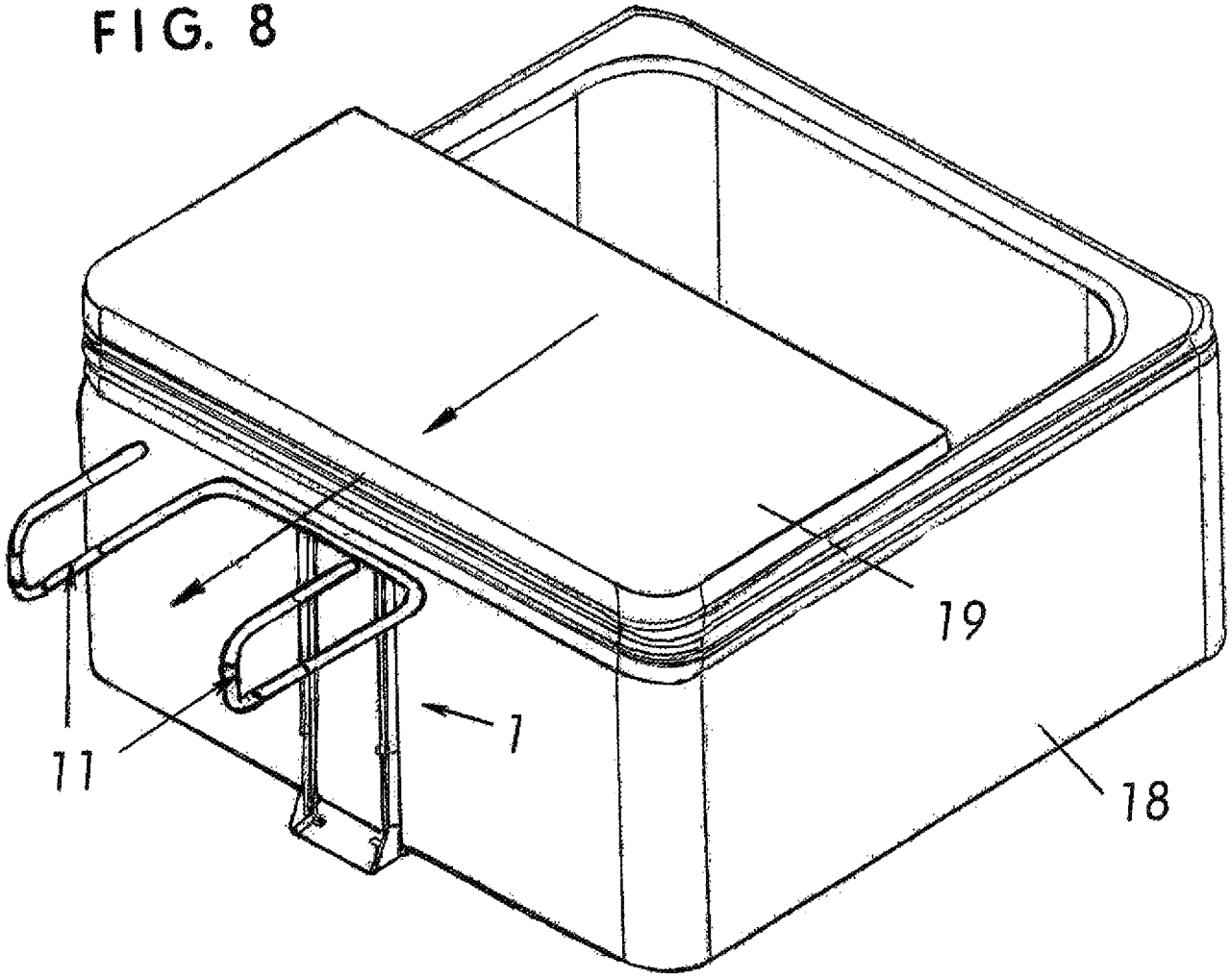
FIG. 8 is perspective view from the top of a spa and present invention shown in FIG. 7, with half of the spa cover folded toward the present invention, the present invention shown in a raised and horizontally-extending orientation ready to receive the spa cover, and arrows pointing in the direction that the spa cover would be moved into the J-shaped cover support arms of the present invention to allow spa use.
Figure 9:
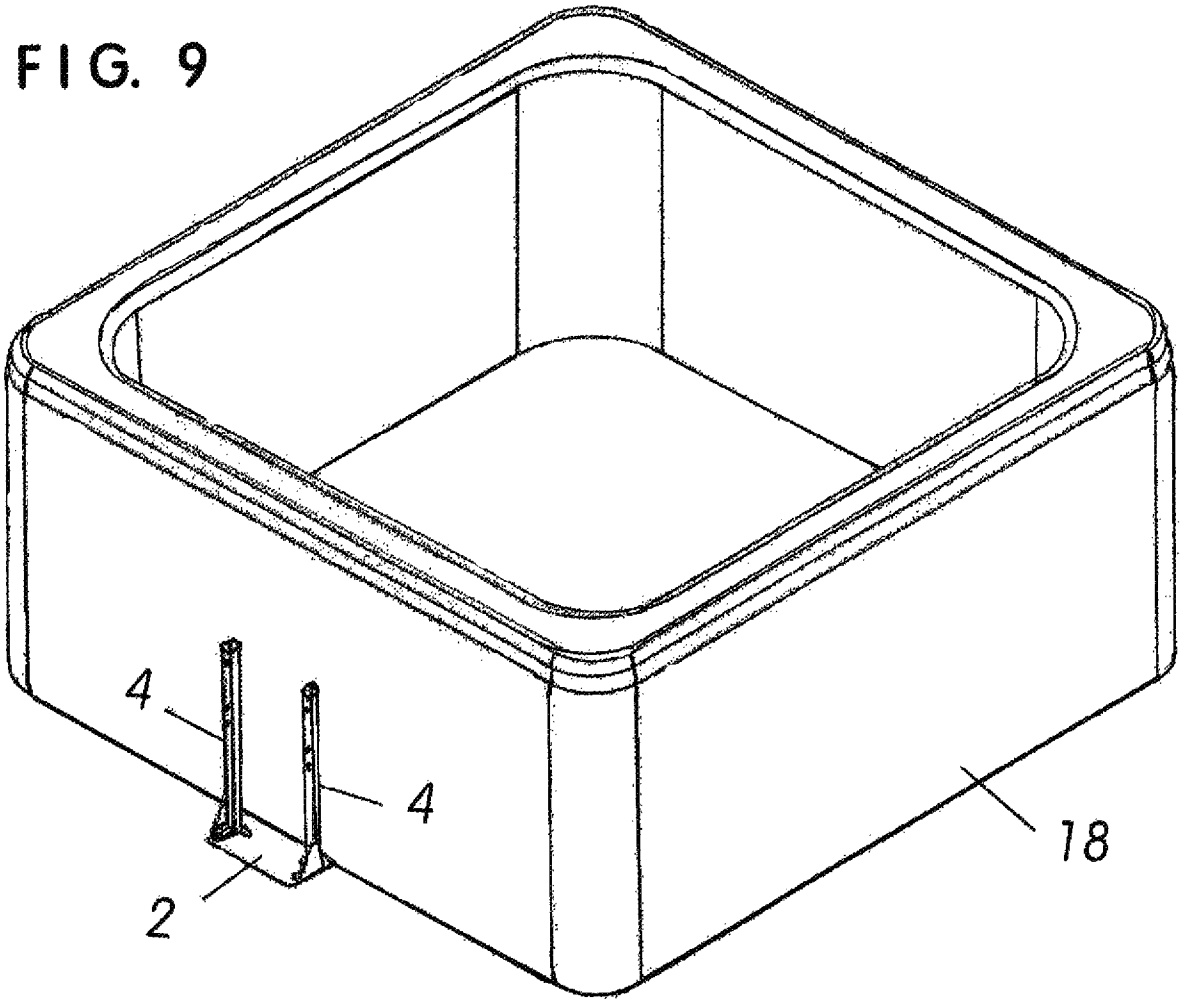
FIG. 9 is perspective view from the top of a spa without a cover, the pre-assembled body with its J-shaped cover support arms removed from the vertically-extending supports, and the portion of the present invention shown in FIG. 1 remaining and still having the elongated undermount portion of its footplate centrally beneath one side of the spa.
Figure 10:
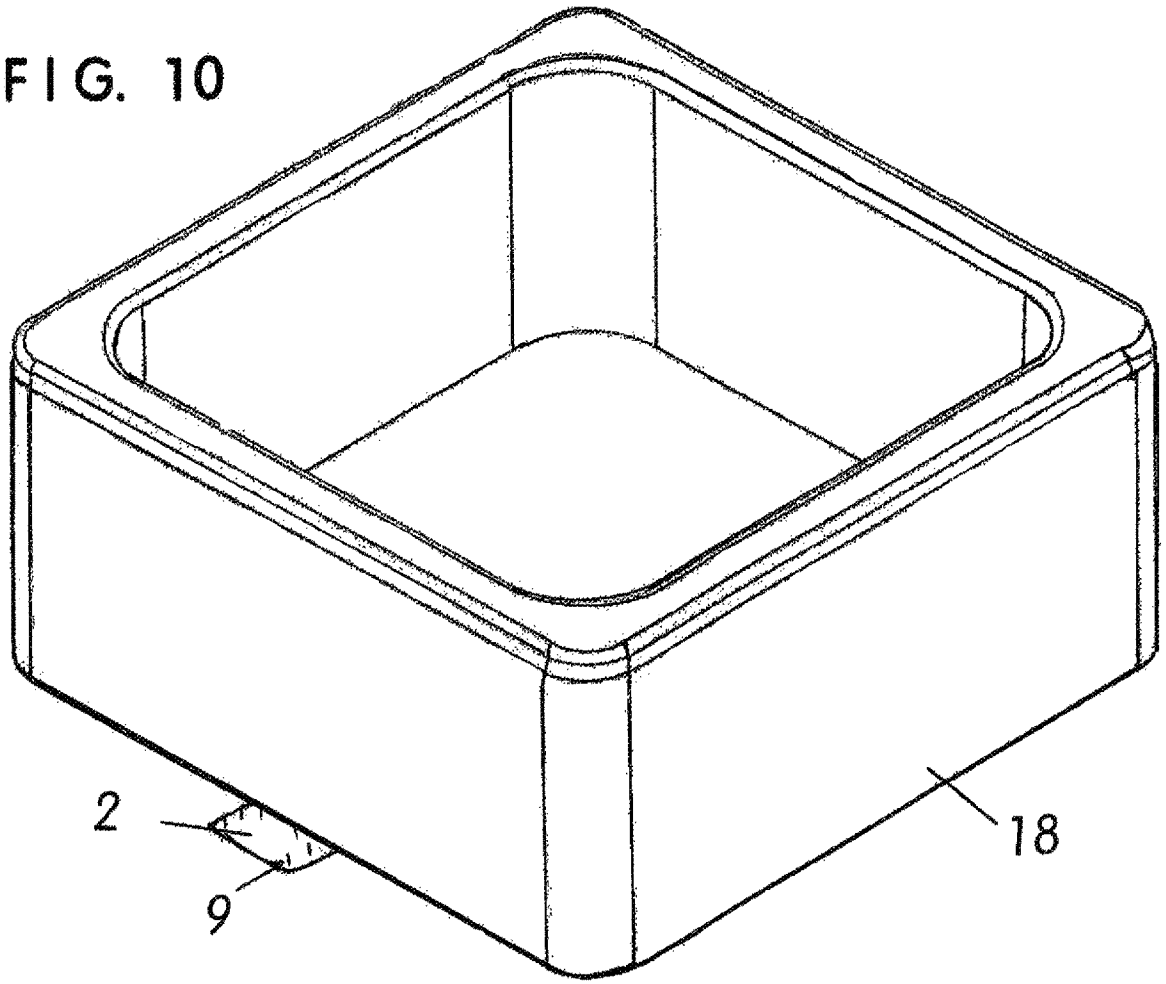
FIG. 10 is perspective view from the top of the spa in FIG. 9, the vertically-extending supports removed from the footplate to expose the portions of the six fasteners permanently attached to the footplate.

FIGS. 7-10 show the most preferred embodiment of the present invention 1 associated with a spa or swim spa 18 in varying configurations and states of disassembly. FIG. 7 is perspective view from the top of a spa 18 with the most preferred embodiment of the present invention 1 centrally against one side of spa 18, the spa cover 19 deployed completely over spa 18, and the present invention 1 shown in a collapsed, compact, and low-profile configuration. In contrast, FIG. 8 is perspective view from the top of a spa 18 and present invention 1, with half of the spa cover 19 folded toward present invention 1 over the other half of spa cover 19. The present invention 1 is further shown in a raised and horizontally-extending orientation to receive the spa cover 19 while in its folded configuration. Arrows point in the direction that the spa cover 19 would be moved into the J-shaped cover support arms 11 of present invention 1 to allow unencumbered spa 18 use. FIG. 9 is perspective view from the top of a spa 18 and the portion of the present invention 1 without its pre-assembled body 22 or J-shaped cover support arms 11. FIG. 10 is perspective view from the top of a spa 18 and the present invention footplate 2 without the vertically-extending supports 4 attached thereto, leaving its permanently attached fasteners 9 exposed.

To assemble and use the present invention 1, one first attaches the vertically-extending supports 4 to the footplate 2 using the pre-installed bolts 9 permanently fixed to footplate 2, and preferably fixed thereto via a welded connection 16. The substantially triangular-shaped brace portions 17 of the two L-shaped brackets 7 should face away from the elongated undermount 3 portion of footplate 2. When the spa or swim spa 18 is empty and unplugged, the elongated undermount 3 portion of footplate 2 can be slid under the center part of spa or swim spa 18 along one of its sides, and the user must be sure that footplate 2 is flat on the ground. The pre-assembled body 22 is then slid downwardly over the upper ends of both of the vertically-extending supports 4, with the connected J-shaped arms 11 facing away from the spa or swim spa 18. The J-shaped arms 11 are next adjusted to the height of the spa or swim spa 18 and its cover 19. The two holes in the bottom part of the pre-assembled body 22 will line up with one of the holes 15 in the vertically-extending supports 4, which are then secured together by inserting each of the two height adjustment knobs 13 through a hole 15 in a different one of the vertically-extending supports 4. Both height adjustment knobs 13 are then firmly tightened to securely fix together the pre-assembled body 22 and the vertically-extending supports 4. Once height adjustment knobs 13 are in place, the J-shaped arms 11 can be elevated into a raised position and the engagement of adjustment push pins 23 thereafter will allow the J-shaped arms 11 to be opened away from one another, allowing the J-shaped arms 11 to properly accommodate the thickness and length of the spa or swim spa cover 19 (when folded in half), with the length of the J-shaped arms 11 arms set to keep the spa or swim spa cover 19 as low as possible without hitting the ground. When proper adjustments are made, the spa or swim spa cover 19 should slide easily into the J-shaped arms 11. The hydraulic lift 12 can be used to tilt the spa or swim spa cover 19 into an out-of-the-way position during spa or swim spa 18 use.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods within the scope and spirit of the invention as disclosed in the accompanying claims.

I claim:

1. A spa and swim spa cover lifter comprising:

a footplate having at least two fastener-receiving holes there through;

two vertically-extending supports each having a bottom end, an upper end, and opposed side surfaces adjacent to said bottom end;

at least one fastener removably affixing each of the two vertically-extending supports to the footplate, the at least one fastener having a permanently fixed connection to the footplate while removably affixing each bottom end of the vertically-extending supports to the footplate; and a pre-assembled body adjusted to receive a spa cover, the pre-assembled body movable into an elevated position adjacent to the spa cover, said pre-assembled body having a lower portion releasably attachable to said upper ends of said vertically-extending supports.

2. The spa and swim spa cover lifter of claim 1 wherein said pre-assembled body comprises:

J-shaped spa cover support arms; and a lifting assist/lowering-assist hydraulic member connected to said J-shaped spa cover support arms.

3. The spa and swim spa cover lifter of claim 2 wherein said J-shaped spa cover support arms are each adjustable to receive spa covers having differing thickness dimensions.

4. The spa and swim spa cover lifter of claim 2, wherein said J-shaped spa cover support arms are each adjustable to receive spa covers having differing length dimensions.

5. The spa and swim spa cover lifter of claim 2 wherein said J-shaped spa cover support arms each further comprise at least one expansion joint for adjustability.

6. The spa and swim spa cover lifter of claim 5 wherein said at least one expansion joint also provides rotation of said J-shaped spa cover support arms, allowing said pre-assembled body to achieve a compact and low-profile non-use configuration.

7. The spa and swim spa cover lifter of claim 5 wherein said at least one expansion joint comprises at least one push pin.

8. The spa and swim spa cover lifter of claim 1 wherein the at east one fastener is a two-part fastener and a first part of each said two-part fastener is a bolt.

9. The spa and swim spa cover lifter of claim 8 wherein a second part of each said two-part fastener is a rounded head nut allowing tool-free hand-manipulated release from and reattachment to said first part of said two-part fastener.

10. The spa and swim spa cover lifter of claim 1 wherein said footplate has an eight-sided perimeter.

11. The spa and swim spa cover lifter of claim 1 wherein said footplate has rounded perimeter edges.

12. The spa and swim spa cover lifter of claim 1 wherein said pre-assembled body is releasably attached to said upper ends of said vertically-extending supports via two height adjustment knobs.

13. The spa and swim spa cover lifter of claim 12 wherein said height adjustment knobs allow tightening and release via tool-free hand manipulation.

14. The spa and swim spa cover lifter of claim 12 wherein said vertically-extending supports each have at least two vertically spaced-apart holes allowing receipt of said height adjustment knobs.

15. The spa and swim spa cover lifter of claim 14, wherein the pre-assembled body further includes holes that align with the at least two vertically spaced-apart holes in the vertically-extending supports to allow height adjustment of the pre-assembled body.

16. The spa and swim cover lifter of claim 1, wherein the footplate has a wider end and an opposed narrower end providing an elongated undermount.

17. The spa and swim cover lifter of claim 16, wherein the wider end of the footplate includes the at least two fastener-receiving holes for receiving the at least one fastener.

18. A spa and swim spa cover lifter comprising:

a footplate having a wider end and an opposed narrower end providing an elongated undermount, the wider end having at least two fastener-receiving holes there through;

two vertically-extending supports each having a bottom end, an upper end, and opposed side surfaces adjacent to said bottom end;

at least one fastener removably affixing the two vertically-extending supports to the footplate, the at least one fastener having a permanently fixed connection to the footplate while removably affixing each bottom end of the vertically-extending supports to the footplate; and a pre-assembled body having connected J-shaped spa cover support arms adjusted to receive a spa cover, the pre-assembled body movable into an elevated position adjacent to the spa cover, the pre-assembled body having a lower portion releasably attachable to the upper ends of the vertically-extending supports, the J-shaped spa cover support arms comprising:

a lifting assist/lowering-assist hydraulic member; and at least one expansion joint to allow the J-shaped spa cover support arms to be at least one of adjusted and rotated.

19. The spa and swim spa cover lifter of claim 18, wherein when the footplate is positioned under a spa, the vertically-extending supports are secured in opposed positions laterally on the footplate, the pre-assembled body is secured to the upper ends of the vertically-extending supports, and the J-shaped spa cover support arms are upwardly extended to receive the spa cover, the J-shaped spa cover support arms stably support the spa cover educe lateral sway.

20. The spa and swim cover lifter of claim 18, wherein the at least one fastener is a two-part fastener, wherein a first part of the two-part fastener is a bolt and the second part of the two-part fastener is a nut allowing tool-free hand-manipulated release from and reattachment to the first part of the two-part fastener, the first part of the two-part fastener having a permanently fixed connection to the footplate.

* * * * *